United States Patent [19]

Wagner et al.

[11] 4,117,735

[45] Oct. 3, 1978

[54] POWER WRENCH

[75] Inventors: Paul-Heinz Wagner, Much-Birrenbachshöhe; Richard Hirtsiefer, Neunkirchen; Johann Müller, Much-Nesshoven, all of Fed. Rep. of Germany

[73] Assignee: Paul-Heinz Wagner Maschinenfabrikation, Fed. Rep. of Germany

[21] Appl. No.: 776,745

[22] Filed: Mar. 11, 1977

[30] Foreign Application Priority Data

Dec. 1, 1976 [DE] Fed. Rep. of Germany ..... 2654466

[51] Int. Cl.[2] ..... F16H 21/18

[52] U.S. Cl. ..... 74/47; 81/57.32

[58] Field of Search ..... 81/57.32, 57.34; 74/47

[56] References Cited

U.S. PATENT DOCUMENTS

| | | | |
|---|---|---|---|
| 1,615,695 | 1/1927 | Grattan | 81/57.32 |
| 2,737,839 | 3/1956 | Paget | 81/57.34 |
| 2,972,918 | 2/1961 | Huff et al. | 81/57.32 |

FOREIGN PATENT DOCUMENTS

| | | | |
|---|---|---|---|
| 299,177 | 10/1972 | U.S.S.R. | 81/57.33 |

*Primary Examiner*—Benjamin W. Wyche
*Assistant Examiner*—Wesley S. Ratliff, Jr.

[57] ABSTRACT

A power wrench having at least a partially annular drive head connected at first and second pivots through a first of a pair of telescopic members and to a third member, respectively, the third member being connected by a third pivot to the second member, and upon a relative linear telescopic motion of the first and second members, the drive head is rotated through a predetermined arc under the control of the third member.

10 Claims, 5 Drawing Figures

FIG.1
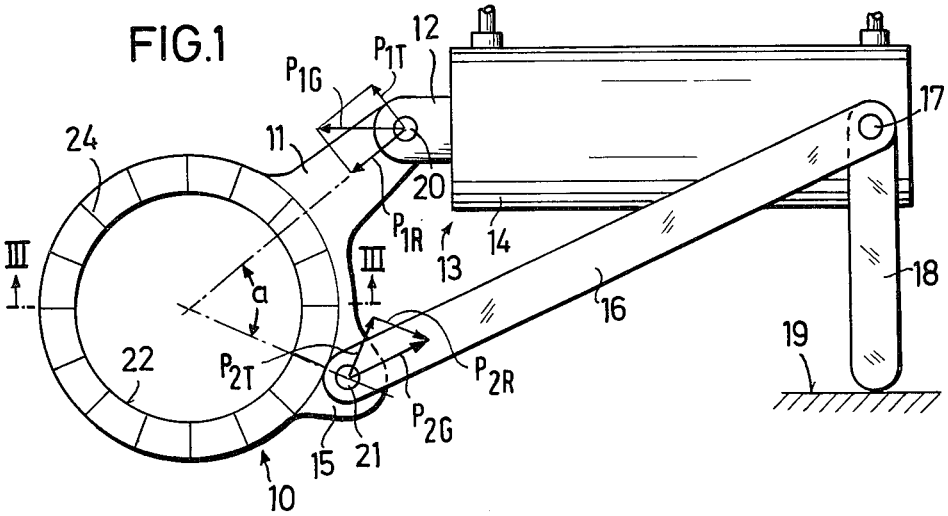
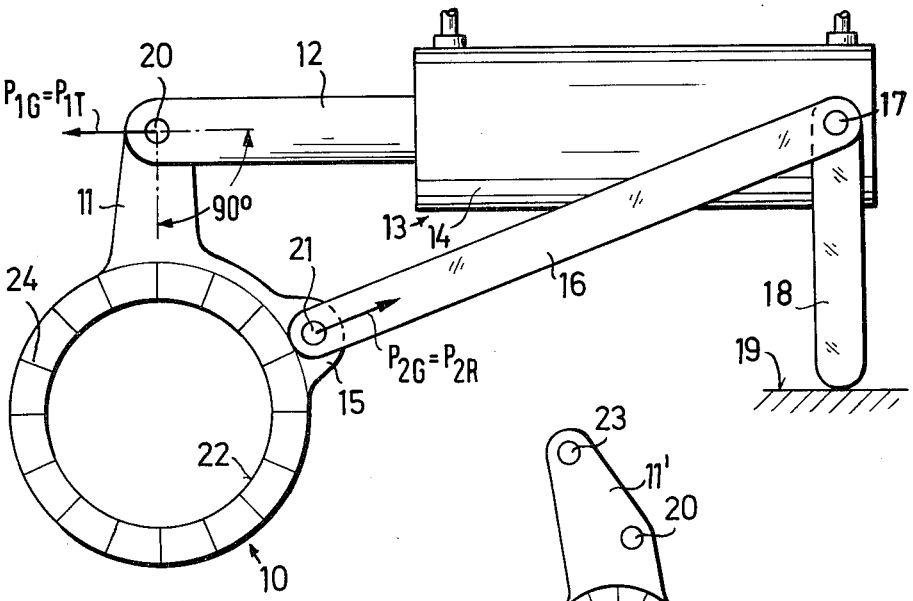
FIG.2
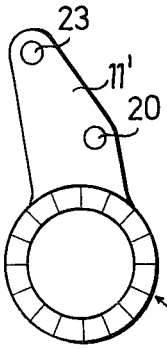
FIG.5

POWER WRENCH

This invention relates to a power wrench which includes a drive or wrench head pivotally connected to one of a pair of relatively linearly telescopic members of a fluid (hydraulic) motor, a third member being pivotally connected to the drive head and a cylinder of the fluid motor, and a supporting leg for supporting the fluid motor and the overall power wrench against a stationary abutememt surface during operation. It is well-known to tighten and loosen heavy screws or bolts by utilizing a power wrench which may conventionally include a fluid (hydraulic) motor or piston-cylinder unit of which the cylinder is pivotally connected to a mounting. When the piston-cylinder unit is pressurized the piston rod thereof extends to pivot a lever arm connected to a wrench or drive head so that the wrench head rotates a screw or bolt to which the wrench head is connected, as exemplified by U.S. Pat. Nos. 3,706,244 and 2,972,918. The supporting means of such conventional power wrenches include a double support in the form of an extensible and retractable piston rod and a traction element. The piston rod or pressure rod is placed against a stationary abutment surface while the traction element or member is hooked into a fixture element in order to obtain the necessary purchase or grip for proper operation.

In keeping with the foregoing, it is a primary object of this invention to provide a novel power wrench of the type heretofore mentioned except the conventional support or mounting is modified such that the traction element is no longer anchored to or in abutment with a stationary surface and instead the traction element is connected between the drive or wrench head and a cylinder of the fluid motor such that reaction forces during operation are utilized concomitantly to support the drive head during its rotation as the piston rod is extended or retracted from the fluid cylinder.

In further accordance with this invention, a power wrench is provided which includes first and second relatively linearly movable members with first pivot means pivotally connecting a first end portion of the first member to an at least partially annular drive head at a first position of the latter, a third or traction member having first and second end portions, second pivot means for pivotally connecting the third member first end portion to the second member, and third pivot means for pivotally connecting the third member second end portion to the drive head at a second position of the latter arcuately spaced from the first position whereby upon relative linear movement of the first and second members, the drive head is rotated through a predetermined arc under the control of the third or traction member.

A further object of this invention is to provide a novel power wrench of the type heretofore described including a supporting foot projecting away from the second member and having a terminal end portion adapted to abut a supporting surface without being positively connected to the latter.

As opposed to conventional power wrenches which the traction element is clamped or connected to a supporting surface, in accordance with the present invention, the wrench head, the traction element, and the fluid motor define a generally closed triangle and during both the inward and outward motion of the associated piston rod, reaction forces are confined to the thus connected elements and are not utilized for clamping purposes. Thus, in order to support the power wrench of the present invention, it a minor matter to simply provide a supporting foot which is merely placed in abutment against a stationary abutment surface but is not clamped or otherwise secured thereto. Thus, forces created by the fluid motor need not be utilized through special fixture arrangements for clamping or otherwise securing the power wrench to a supporting surface.

Another problem with conventional power wrenches of the type to which the invention is directed, is their failure to utilize to a maximum the tangential force applied by the piston rod to the wrench or drive head. As the piston rod is extended the force thereof is broken down into a radial component and a tangential component and only the tangential component is effective for tightening or loosening purposes, or stated otherwise, only the tangential force is effective to impart rotation to the drive head. The ratio of the tangential and radial components of force progressively change as the piston rod is extended and thus the effective tangential force is altered progressively. However, in keeping with the present invention, the tangential force or torque is maximized during the outward motion of the piston rod relative to the fluid cylinder and, moreover, any changes in the tangential force can be readily measured in a conventional manner and the fluid introduced into the fluid cylinder can be appropriately regulated to maintain the tangential torque at a constant value, if so desired.

Furthermore, in keeping with the present invention, the traction element or traction member directs reaction forces between the drive head and the fluid cylinder which generates added torque which becomes greater as the piston rod progressibely extends from the fluid cylinder, thus imparting maximum torque or turning moment to the wrench or drive head.

In further accordance with this invention, the maximum utilization of tangential torque is realized by a novel construction of the invention such that in the fully extended position of the piston rod, the longitudinal axis of the latter is generally normal to a line taken between the center point of the wrench or drive head and the pivot point connecting the wrench or drive head to the piston rod, and in the same position the longitudinal axis of the traction element is disposed radially to the wrench head center.

During the outward movement of the piston rod, maximum torque is applied to the wrench head while the torque exerted by the traction member is extremely low or equal to zero. As the torque decreases due to the angle between the longitudinal axis of the piston rod and the line between the center of the wrench head and the pivot point connecting the wrench head to the piston rod, the torque increases which is transferred by the traction lever to the wrench head so that the total torque is nearly constant. Thus, the power wrench is capable of performing the rotation of a screw or bolt through a relatively large angle with a constant torque before the wrench head must be reapplied at the screw head or bolt head.

In further keeping with this invention, the pivot point at which the traction member is connected to the wrench head is so spaced from the center of the wrench head that the force created during the completely retracted position of the piston rod generates a torque corresponding at least approximately to the torque loss at the first outward extension of the piston rod, this being relative to the maximum torque. Due to this, the torque loss dictated by the position of the piston rod can be easily compensated for by the traction lever.

Upon unscrewing the screws or bolts, it may become necessary to apply a substantially greater torque than required for tightening the latter. This is obviously due to the "setting" behavior of screws, bolts and the like and such normal environmental conditions as dirt, rust, etc. In order to unscrew such screws or bolts having a very firm seat, it is not required as a general rule to measure the torque but a very high torque is generally necessary or desirable. In order to meet such requirements, the piston rod of the drive unit or fluid motor is connected to a radially projecting shoulder of the wrench head and the traction lever is attached to a radially projecting second shoulder of the wrench head. At least one of the latter shoulders is relatively elongated and is provided with a second pivot point in which the traction arm or the piston rod can be connected to, in effect, extend the length of the traction rod. With such a transfer of the piston rod or the traction lever, the linearity between the applied torque and the drive force or the hydraulic pressure, is not lost and it is possible to achieve extremely high torques.

With the above and other objects in view that will hereinafter appear, the nature of the invention will be more clearly understood by reference to the following detailed description, the appended claimed subject matter, and the several views illustrated in the accompanying drawing.

IN THE DRAWINGS

FIG. 1 is a side elevational view of a novel power wrench constructed in accordance with this invention, and illustrates a piston rod of a fluid motor connected to a radial projection of an annular wrench head and a traction member pivotally connected to another radial extension of the wrench head and a cylinder of the fluid motor.

FIG. 2 is a side elevational view similar to FIG. 1 and illustrates the piston rod in its most extended position along with a supporting foot resting against an abutment surface.

Figure 3:
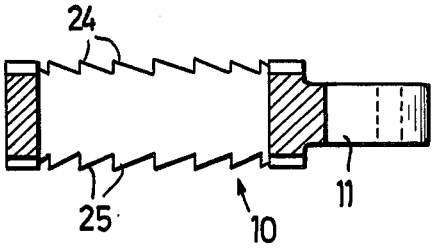
FIG. 3 is a cross sectional view taken generally along line III—III of FIG. 1, and illustrates a plurality of ratchet teeth upon upper and lower surfaces of the wrench head.

FIG. 5, which appears on the sheet of drawing containing FIGS. 1 and 2 illustrates a modified wrench head, and illustrates a radially projecting member having two apertures therein serving as pivot points for the piston rod and/or traction element.

A novel power wrench constructed in accordance with this invention is best illustrated in FIGS. 1 and 2 and includes an annular wrench head or drive head 10 designed as a socket wrench. Though the wrench or drive head 10 is illustrated as being totally annular, it may, of course, be partially annular such as to be opened through one side thereof in the form of a spanner wrench which may be applied latterly upon a screw head or bolt head. Furthermore, though an inner peripheral surface 22 of the drive head 10 is perfectly cylindrical, the latter may also be provided instead with a plurality of "flats" such that the drive head 10 is, in effect, a spanner wrench or if fully circular, a box wrench.

The wrench or drive head 10 includes a first generally radially outwardly directed projection or extension 11 at which first pivot means 20 connects the projection 11 to a first end portion (unnumbered) of a first movable member or piston rod 12 forming a portion of a fluid (hydraulic) motor 13 which includes as a part thereof, a hydraulic cylinder 14. The piston is not, of course, illustrated in FIG. 1, but is connected to a second end portion (not shown) of the piston rod 12 and through the use of two hydraulic pressure lines (unnumbered) fluid is introduced in a conventional manner into the cylinder 14 to extend and retract the piston rod 12 in a known manner. Suitable controls may be provided in the lines to regulate the pressure applied against the piston (not shown) during extension or retraction thereof.

The wrench head 10 also includes a second radially outwardly directed extension or projection 15 which is associated with a third member or traction element 16. The third member or traction element 16 is connected by second pivot means 17 to the fluid cylinder 14 and by third pivot means 21 to the projection 15. The pivot means 17 also pivotally connects a supporting leg 18 to the cylinder 14, and a terminal end portion (unnumbered) of the supporting leg 18 rests or abuts against an abutment or supporting surface 19.

When the piston rod 12 is being extended outwardly of the cylinder 14 under the influence of fluid pressure a force $P_{1G}$, and the latter force at the pivot means 20 is divided into a radial component $P_{1R}$ and a tangential component $P_{1T}$ of which only the tangential component $P_{1T}$ contributes to the turning of the wrench head 10.

Due to the force $P_{1G}$ of the piston rod 12, a traction force $P_{2G}$ is created in the traction member 16, and the traction force is likewise divided into a tangential component $P_{2T}$ and a radial component $P_{2R}$. The tangential force component $P_{2T}$ has the same sense or direction of rotation during the extension of the piston rod 12 as the tangential force component $P_{1T}$ at the pivot means or pivot 20.

Prior to the extension of the piston rod 12 outwardly of the cylinder 14, as is illustrated in FIG. 1, an angle "*a*" of approximately 60° is defined between the center (unnumbered) of the wrench head 10 and the pivot points 20, 21. It is also to be noted that the radial length of the extension or projection 15 is substantially less than that of the extension or projection 11.

When the piston rod 12 has reached its fully extended position (FIG. 2), the angle "*a*" is increased and the entire force of the piston $P_{1G}$ is equal to the tangential force $P_{1T}$.

In the position shown in FIG. 2, the longitudinal axis of the piston rod 12 is substantially normal ("90°" ) to the line (unnumbered) extending between the center (unnumbered) of the wrench head 10 and the axis of the pivot 20. This, of course, is the maximum outward extension of the piston rod 12. Obviously, as the piston rod 12 extends outwardly from the position shown in FIG. 1 toward the position shown in FIG. 2, the wrench head 10 is turned through a predetermined arc in a counterclockwise direction, and this motion is imparted to a screw head or bolt head through a plurality of ratchet teeth or ratchets 24 or 25 disposed on upper and lower faces of the wrench head 10, as is best illustrated in FIG. 3. The wrench head 10 is slipped upon a shaft 28 of a drive socket 26 having upwardly directed ratchet teeth or ratchets 27 which correspond to the ratchet teeth 24, 25 of the socket 10, the ratchet teeth 24, 25 of the wrench head 10 and the ratchet teeth 27 of the drive socket 26 are so arranged that upon outward extension of the piston rod 12 the flat faces (unnumbered) of the ratchet teeth 24 or 25 and 27 engage to impart rotation to the drive socket 26, and upon retraction of the piston rod 12 the tapered surfaces (unnumbered) of the ratchet teeth 24 or 25 and 27 simply slide across each other in a known manner to allow the wrench head 10 to rotate relative to the shaft 28 of the drive socket 26 in a known fashion.

Figure 4:
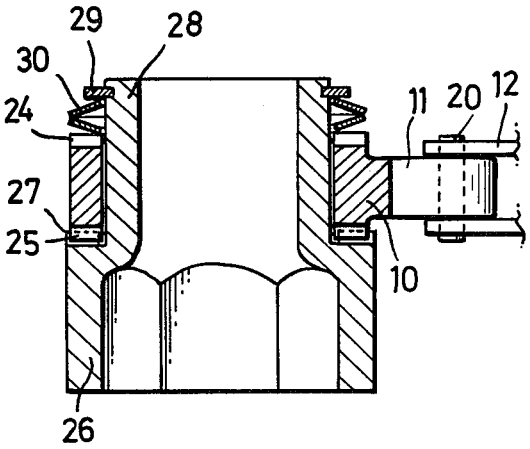
FIG. 4 is a sectional view similar to FIG. 3, and illustrates the ratchet head applied to a drive socket.

The wrench head 10 is retained upon the shaft 28 of the drive socket 26 by a retaining ring 29. A pair of Belliville washers or annular springs 30 are positioned between the retaining ring 29 and the ratchet teeth 24. The purpose of the annular springs 30 is to normally maintain the ratchet teeth 25, 27 in engagement during the outward movement of the piston rod 12 whereas upon inward movement of the piston rod 12 the wrench head 10 can rise upwardly, as viewed in FIG. 4, against the springs 30 to permit the wrench head 10 to rotate relative to the shoulder 28. Obviously, the wrench head 10 can be positioned relative to the shoulder 28 such that the teeth 24 engage the teeth 27 for opposite driving motion during the extension of the piston rod 12. Thus, by utilizing either of the ratchet teeth 24, 25 in engagement with the ratchet teeth 27 of the drive socket 26, the latter can be driven clockwise or counterclockwise for loosening or tightening bolts or screws.

If the ratchet effect heretofore described, which is achieved by the ratchet teeth 24, 25 and 27, is considered unnecessary, the wrench or drive head 10 may be constructed as heretofore noted, namely, by instead of the cylindrical intersurface 22, a portion of the wrench head 10 may be broken away and the internal surface may be provided with appropriate flats so that the wrench head or drive head 10 is, in effect, a spanner wrench or, alternatively, the wrench head 10 need not be broken away and the entire internal surface may be provided with a plurality of flats to, in effect, form a "box" wrench.

The torque exerted on the wrench head 10 increases progressively during the outward extension of the piston rod 12 but at the same time the radial component of force $P_{2R}$ exerted on the traction rod or traction member 16 is constantly reduced so that the total torque is kept practically constant over the entire arcuate rotation of the wrench head 10 between the position shown in FIG. 1 to the position shown in FIG. 2. Thus, it is possible, if desired, to connect a pressure gauge to the lines (unnumbered) of the fluid cylinder 14 to indicate the force applied to the screw or nut or to in a similar fashion, limit the amount of force applied to the screw or nut through the use of a relief valve when pressure reaches a predetermined maximum. In this manner, the amount of pressure applied to a screw or bolt can be predetermined and accurately determined.

If a linear relationship between the applied screw moment or torque and the force or pressure of the piston rod 12 is unnecessary, the wrench head 10 may be modified in the manner illustrated in FIG. 5 wherein like reference characters 10', 11' correspond to the wrench head 10 and 11, respectively, of FIG. 1. However, in keeping with the embodiment of the invention illustrated in FIG. 5, the projection or extension 11' is appreciably longer than the projection 11 of the power wrench of FIGS. 1 and 2 and in addition to the pivot means or aperture 20, there is provided another pivot means or aperture 23. The pivot means 20, 23 are obviously different radial distances from the center (unnumbered) of the wrench head 10'. Thus, if the piston rod 12 is connected to the pivot point 20, a predetermined torque will be achieved depending upon the pressure within the cylinder 14 but under the same pressure a higher torque will be achieved if the piston rod 12 is connected to the pivot 23. It will, therefore, be highly desirable to connect the piston rod 12 to the pivot 23 where a great amount of torque is required for unscrewing a screw or bolt.

Due to the construction heretofore described, the wrench head 10 or 10' may be constructed relatively thin or narrow to permit the power wrench access to screws or bolts which are near walls or other inaccessable constructional areas. The power wrench can, thus be utilized in narrow nitches or crevices where only a small amount of angular sector is available for rotational purposes.

While the invention has been thus far described with the piston rod 12 being the pressure applier and the traction member 16 compensating for reactive forces which are transmitted to the cylinder 14, the reverse is also possible. That is, the piston rod 12 may be utilized as a traction rod and the traction member 16 may be used as the pressure or force applicator. In this case, the supporting foot 18 is merely pivoted 180° from the position shown so that it rests against another supporting surface. Furthermore, though the invention has been described in connection with a fluid or hydraulic motor, equivalence thereof may be utilized.

What is claimed is:

1. A power wrench comprising first and second relatively linearly movable members, an at least partially annular drive head means for rotating screws, nuts and the like, first pivot means for pivotally connecting a first end portion of said first member to said drive head at a first position of the latter, a third member having first and second end portions, second pivot means for pivotally connecting said third member first end portion to said second member, third pivot means for pivotally connecting said third member second end portion to said drive head at a second position of the latter arcuately spaced from said first position whereby upon relative linear movement of said first and second members turning torque is imparted to said drive head means through both said first and third members whereby said drive head means is rotated through a predetermined arc under the control of said third member, supporting means articulately connected to said second member for freely contacting a support surface along any one of a plurality of points thereof, and said supporting means being disposed generally normal to said second member during the operation of said power wrench including the relative linear movement of said first and second members.

2. The power wrench as defined in claim 1 wherein said supporting means consists solely of a supporting foot projecting away from said second member and having a terminal end portion adapted to abut the support surface along any one of said plurality of points.

3. The power wrench as defined in claim 1 wherein at only one relative position between said first and third members and said drive head is a line between a center of said at least partially annular drive head and said first pivot means generally normal to a longitudinal axis of said first member, and in said same only one relative position a longitudinal axis of said third member is in radial relationship to said at least partially annular drive head.

4. The power wrench as defined in claim 1 wherein said at least partially annular drive head has a center, said first and second members are relatively movable between first extended and second retracted positions, and the radial distances between the center of the drive head and the first and second pivot means in said second retracted position is such that the initial force acting at said first pivot means generates a torque thereat corresponding to the torque loss at said second pivot means relative to maximum torque.

5. The power wrench as defined in claim 1 wherein said drive head includes first and second peripherally outwardly directed projections, and said first and second projections receive said respective first and second pivot means.

6. The power wrench as defined in claim 1 wherein said drive head includes a peripherally outwardly directed projection, and said projection includes first and second connecting means spaced different radial distances from the center of said at least partially annular drive head for connecting thereto said first and second pivot means, respectively, and vice versa.

7. The power wrench as defined in claim 1 wherein said first and second members are in relative telescopic relationship.

8. The power wrench as defined in claim 1 wherein said first and second members are in relative telescopic relationship, said first member includes a piston rod, and said second member is a fluid cylinder.

9. The power wrench as defined in claim 2 wherein at only one relative position between said first and third members and said drive head is a line between a center of said at least partially annular drive head and said first pivot means generally normal to a longitudinal axis of said first member, and in said same only one relative position a longitudinal axis of said third member is in radial relationship to said at least partially annular drive head.

10. The power wrench as defined in claim 2 wherein said supporting foot is articulately connected to said second member.

* * * * *